US007023142B2

(12) United States Patent
Chou et al.

(10) Patent No.: US 7,023,142 B2
(45) Date of Patent: Apr. 4, 2006

(54) LIGHT MODULATION METHOD AND APPARATUS FOR COLD CATHODE FLUORESCENT LAMPS

(75) Inventors: Chin-Wen Chou, Hsin-Tien (TW); Eddie Cheng, Hsin-Tien (TW); Kuang-Ming Wu, Hsin-Tien (TW); Chin-Biau Chung, Hsin-Tien (TW)

(73) Assignee: Zippy Technology Corp., Taipei Hsien (TW)

( * ) Notice: Subject to any disclaimer, the term of this patent is extended or adjusted under 35 U.S.C. 154(b) by 0 days.

(21) Appl. No.: 10/840,228

(22) Filed: May 7, 2004

(65) Prior Publication Data

US 2005/0248288 A1 Nov. 10, 2005

(51) Int. Cl.
*H05B 37/02* (2006.01)

(52) U.S. Cl. ..... 315/209 PZ

(58) Field of Classification Search ..... 315/224, 315/209 PZ, 294, 291, 307, DIG. 2
See application file for complete search history.

(56) References Cited

U.S. PATENT DOCUMENTS

| | | | | |
|---|---|---|---|---|
| 5,859,489 | A * | 1/1999 | Shimada | 310/318 |
| 6,016,052 | A * | 1/2000 | Vaughn | 323/355 |
| 6,400,096 | B1 * | 6/2002 | Wells et al. | 315/224 |
| 6,525,492 | B1 * | 2/2003 | Ribarich | 315/291 |
| 6,853,153 | B1 * | 2/2005 | Gray | 315/291 |

FOREIGN PATENT DOCUMENTS

| | | |
|---|---|---|
| TW | 504101 | 9/2002 |

* cited by examiner

*Primary Examiner*—Tuyet Vo
*Assistant Examiner*—Minh Dieu A
(74) *Attorney, Agent, or Firm*—Birch, Stewart, Kolasch & Birch, LLP

(57) ABSTRACT

A method and apparatus for modulating light of CCFLs that couples frequency alteration and pulse width modulation (PWM) approaches to change output voltage and current of a piezoelectric transformer to modulate the luminosity of a CCFL. The invention includes a PWM controller to alter operation cycle and a frequency control IC to change resonant frequency that drives the piezoelectric transformer at different operation cycles thereby to modulate the luminosity of the CCFL and improve the life span of the piezoelectric transformer.

7 Claims, 6 Drawing Sheets

LIGHT MODULATION METHOD AND APPARATUS FOR COLD CATHODE FLUORESCENT LAMPS

FIELD OF THE INVENTION

The present invention relates to a method and apparatus for modulating light of a cold cathode fluorescent lamp (CCFL) and particularly to a method and apparatus that changes the driving method of a piezoelectric transformer to alter output voltage and power supply of the piezoelectric transformer to modulate the luminosity of the CCFL.

BACKGROUND OF THE INVENTION

Ceramic piezoelectric transformer was first introduced in 1956 by C. A. Rosen. Its operation principle is different from the magnetic transformer which functions through transformation of electromagnetic energy. The piezoelectric transformer first transforms electromotive force to mechanical energy (this process is called inverse piezoelectric effect), then the mechanical energy is transformed to electric energy (this process is called positive piezoelectric effect).

The developments of the magnetic transformer and piezoelectric transformer make fabrication of high efficient and small size converters possible. Compared with the piezoelectric transformer, in a given power, the magnetic transformer might be thicker and heavier and have a lower efficiency. But its cost is lower and can operate in a wider range of loads. Hence conventional CCFLs that require a high actuation voltage and a high trigger voltage are supported by winding magnetic transformers that have high coil ratios. Nevertheless, developments of piezoelectric transformer have increasingly provided more advantages in those applications, such as higher efficiency, smaller size, lower electromagnetic noise, higher trigger voltage, non-flammable, and can operate in a sinusoid mode.

Conventional switching mode regulators regulate On/Off time of a power circuit to output different voltages and currents. Its basic operation principle is to set a power switch On/Off through a controller. The mostly used element is MOSFET. Through the operation of controlling the switch, a required voltage and current can be achieved.

The commonly used control method is pulse width modulation (PWM) that directly or indirectly compares output voltage with a triangular wave level to determine On/Off time period. Namely, when the level of the triangular level is higher (or lower) than a selected level, a upper MOSFET connecting to the electric power is opened. On the contrary, due to rectified inductance will keep the current continuous, the current will flow through a current passage at the lower side. The opening time ratio of the upper MOSFET is called operation cycle. The switching mode regulator basically alters the operation cycle to change voltage.

R.O.C. patent No. 504101 discloses a "High luminous fluorescent lamp driving apparatus" which includes a high frequency oscillator, a pulse width modulator, a first and a second power switches, and a piezoelectric transformer. The high frequency oscillator generates a high frequency AC signal which is transformed by the pulse width modulator to become a PWM resonant frequency signal. The positive half cycle and the negative half cycle of the PWM resonant frequency signal drive respectively the two power switches, then drive respectively two input ends of the primary coil of the piezoelectric transformer to enable the piezoelectric transformer to generate a voltage sufficient to actuate the CCFL. The CCFL driving apparatus thus formed has a high transformation efficiency and high voltage boosting ratio. In other words, the cited reference employs PWM approach to drive the piezoelectric transformer through a high and constant frequency signal. Through the non-continuous conductive mode of the constant frequency to control On/Off of the power switches. Such a method usually uses a high frequency (>100 Hz) not sensible to human eyes and through modulating non-conductive void ratio to control the average current of the fluorescent lamp. The frequency is constant.

There is another method called burst mode announced by Philips. It is a technique also called hiccup mode or cycle omitted mode. When the load drops abruptly, a control circuit requests to shorten $T_{on}$. Under a selected load, the pulse type control circuit starts to prevent conductive period Ton from decreasing, meanwhile a cyclical pulse is started to mask wave width modulation. Power may be saved by decreasing the pulse cluster width or increasing mask cycle period in different loads. Such a technique has two obvious drawbacks, i.e. low frequency interference and the mask cycle have resonant oscillation. And abrupt change of load also will cause abrupt drop of output voltage. To the piezoelectric transformer driven by such a power control mode will cause the piezoelectric transformer to be charged frequently or operate repeatedly even the power is completely cut off. This affects the life span of the piezoelectric transformer.

SUMMARY OF THE INVENTION

The present invention aims to provide a method for modulating light of a CCFL and particularly to a method that couples frequency alteration and pulse width modulation to change output voltage and current of the piezoelectric transformer thereby to modulate the luminosity of the CCFL.

The invention employs a resonant frequency control unit to dynamically change the resonant frequency that drives the piezoelectric transformer, namely, through dynamical frequency alteration to change the voltage gain of the piezoelectric transformer thereby to modulate the output voltage and current of the piezoelectric transformer and the luminosity of the CCFL.

Another object of the invention is to provide a power control apparatus to modulate the output voltage and current of the piezoelectric transformer without incurring negative effect to the life span of the piezoelectric transformer.

The invention further uses a PWM control unit to couple the pulse width modulation control method and the aforesaid dynamic frequency alteration control method to adjust the voltage gain of the piezoelectric transformer through a resonant frequency which has altered frequency but unchanged amplitude and the void ratio approach to change output voltage and current of the piezoelectric transformer. The method according to the invention does not frequently charge the piezoelectric transformer or completely stops charge operation. Compared with the conventional burst mode or pulse width modulation control approaches, the invention can increase the life span of the piezoelectric transformer.

DETAILED DESCRIPTION OF THE PREFERRED EMBODIMENTS

Figure 1:
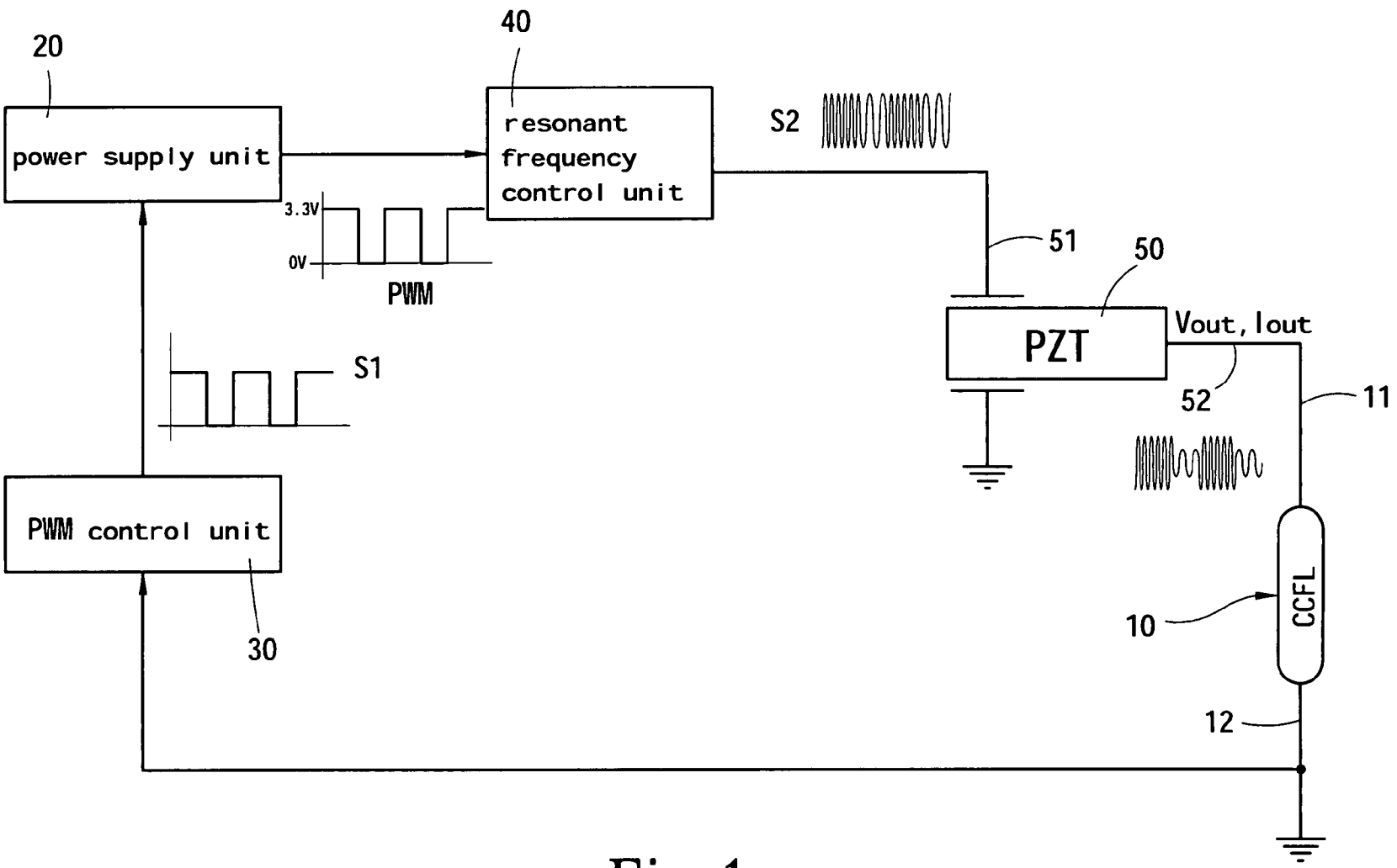
FIG. 1 is a circuit architecture of a first embodiment of the present invention.
Figure 4:
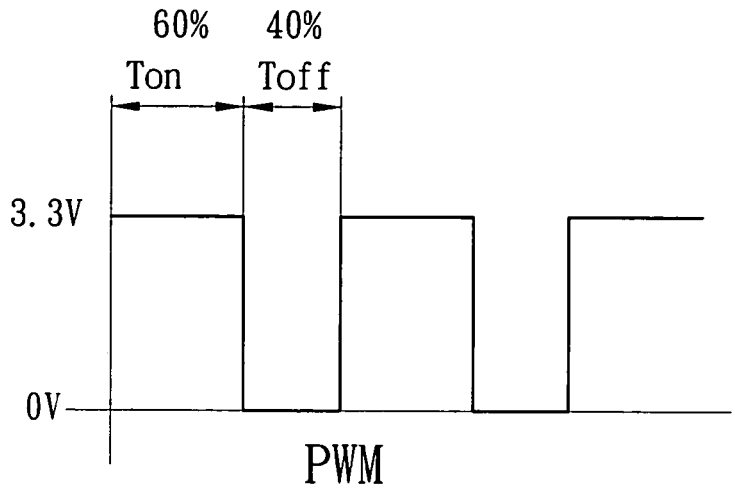
FIG. 4 is a schematic view of the waveform of a pulse width modulation control signal.

Please refer to FIG. 1 for a first embodiment of the present invention. The light modulation apparatus according to the invention adopted for use on a CCFL 10 includes:

a power supply unit 20 to provide DC power required to actuate the CCFL 10 (depending on CCFL specifications, in general a DC power with voltage from 0 volt to several volts);

a PWM control unit 30 to output a pulse signal S1 through a pulse width modulation technique and through the pulse signal S1 to control the power supply unit 20 to output a pulse width modulation control signal with operation cycles $T_{on}$ and $T_{off}$, namely through the pulse signal S1 to change the void ratio of DC current output from the power supply unit 20 between 0 volt (0 V) and full amplitude (such as 3.3 V). Referring to FIG. 4 for the output waveform;

a resonant frequency control unit 40 which is a frequency control IC to modulate the pulse width modulation control signal output from the power supply unit 20 to a high frequency AC signal S2. And the resonant frequency control unit 40 will generate respectively the high frequency AC signal S2 of different frequencies f1 and f2 at different operation cycles $T_{on}$ and $T_{off}$ (referring to FIG. 5 for the waveforms) to change the voltage gain of a piezoelectric transformer 50. Namely, the pulse width modulation control signal automatically changes the frequencies f1 and f2 of the high frequency AC signal S2 at different operation cycles $T_{on}$ and $T_{off}$; and the piezoelectric transformer 50 which has a primary electrode 51 connecting to the high frequency AC signal S2 output from the resonant frequency control unit 40 to boost the gain of the high frequency AC signal S2 to become a high output voltage $V_{out}$ and an output current $I_{out}$ required to drive the CCFL that are output from a secondary electrode 52. The high output voltage $V_{out}$ and output current $I_{out}$ are connected to a high voltage side electrode 11 of the CCFL 10 to actuate the CCFL 10 to generate light. A voltage signal is generated on a low voltage side electrode 12 of the CCFL 10 that is fed to the PWM control unit 30, and through modulating the pulse width of the pulse signal S1 to modulate the luminosity of the CCFL 10.

Figure 2:
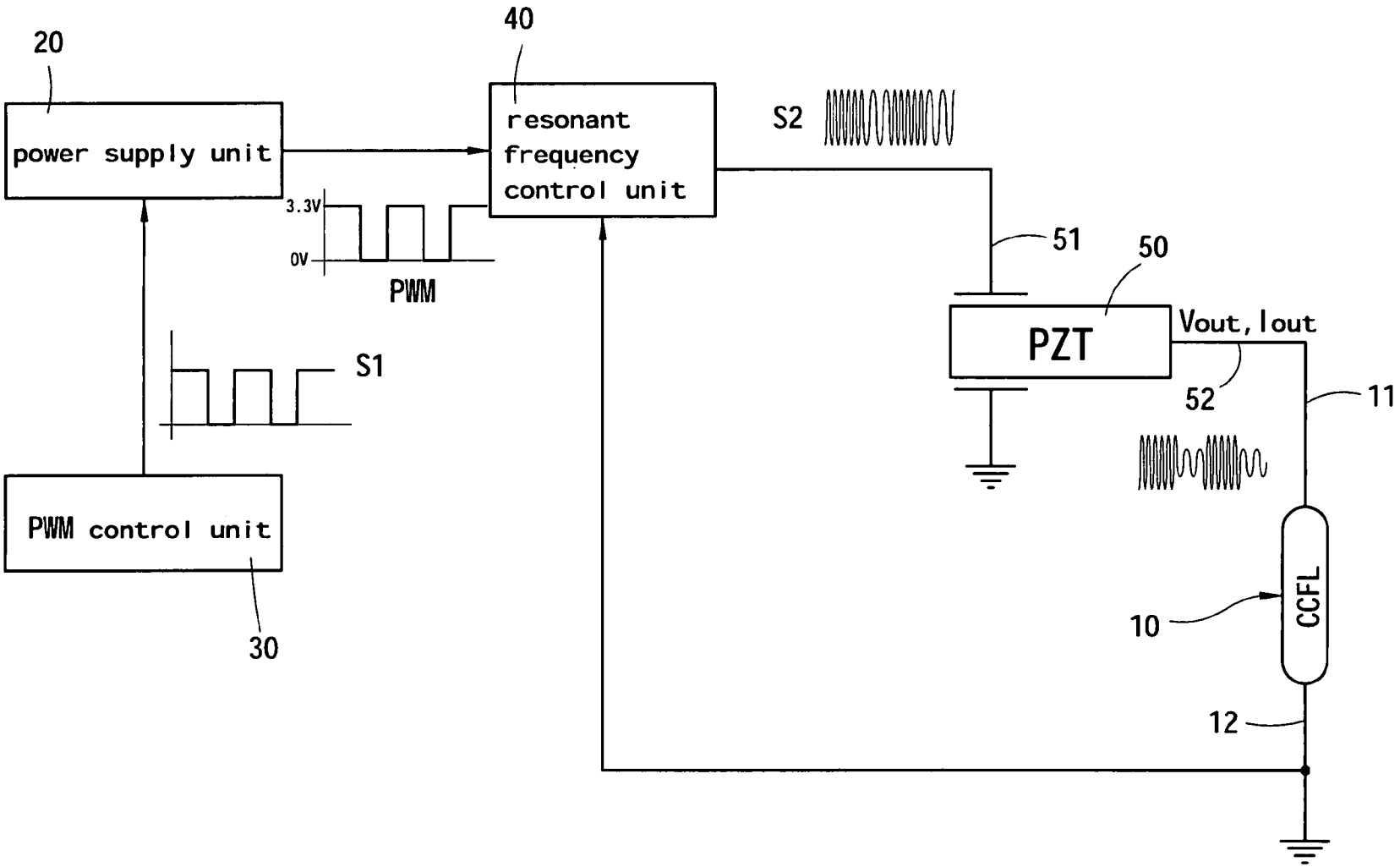
FIG. 2 is a circuit architecture of another embodiment of the present invention.

Another embodiment is to feed back the voltage signal of the lower voltage side electrode 12 of the CCFL 10 to the resonant frequency control unit 40 (referring to FIG. 2), and through altering the frequencies f1 and f2 of the high frequency AC S2 at the different operation cycles $T_{on}$ and $T_{off}$ to modulate the luminosity of the CCFL 10.

Figure 3:
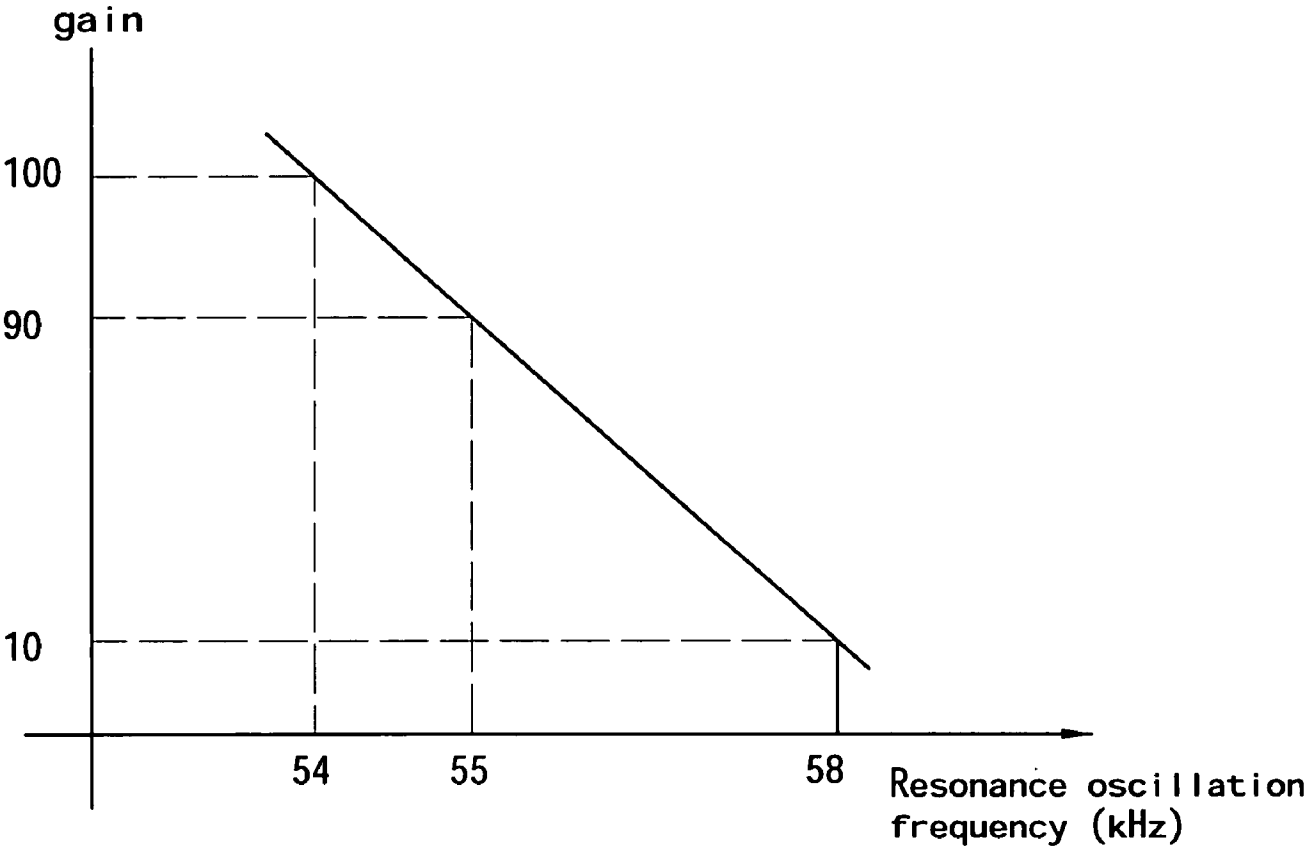
FIG. 3 is a chart showing the relationship of voltage gain and resonance oscillation frequency of the piezoelectric transformer.

The voltage gain of the piezoelectric transformer 50 not merely depends on its structure (such as single layer or laminated structure), its output voltage gain may also be modulated by altering the high frequency AC signal S2 (referring to FIG. 3). For instance, if the gain value is 100 when the high frequency AC signal S2 is 54 kHz, it means that the output voltage output from the secondary electrode 52 will be 100 times of the input voltage value of the primary electrode 51. Namely, if the input voltage is 3.3 V, the output voltage will be 330 V.

On the contrary, if the gain drops to 10 after the frequency of the high frequency AC signal S2 is changed to 58 kHz, the output voltage output from the secondary electrode 52 will be 10 times of the input voltage value of the primary electrode 51. Namely, if the input voltage is 3.3 V, the output voltage will be 33 V. Using this characteristic, the invention employs the resonant frequency control unit 40 to generate the high frequency AC signal S2 of different frequencies f1 and f2 when the pulse width modulation control signal are at different operation cycles $T_{on}$ and $T_{off}$, and uses the high frequency AC signal S2 to drive the piezoelectric transformer 50 to function. Then by modulating output voltage gain of the piezoelectric transformer 50 to alter output voltage and current of the piezoelectric transformer 50 without changing the amplitude of the pulse width modulation control signal, thereby to modulate the luminosity of the CCFL 10.

The conventional pulse width modulation control method modulates the luminosity of a CCFL mainly by controlling CCFL current through altering the void ratio of the pulse width modulation control signal and the amplitude of a constant resonant frequency. Such an approach uses a high frequency (>100 Hz) not sensible to human eyes to alter the void ratio to control the average CCFL current thereby to make the CCFL to operate constantly in the full current condition. While it can modulate the luminosity, the piezoelectric transformer is switched frequently under charged or not fully charged condition. It has negative impact to the life span of the piezoelectric transformer.

Figure 5:
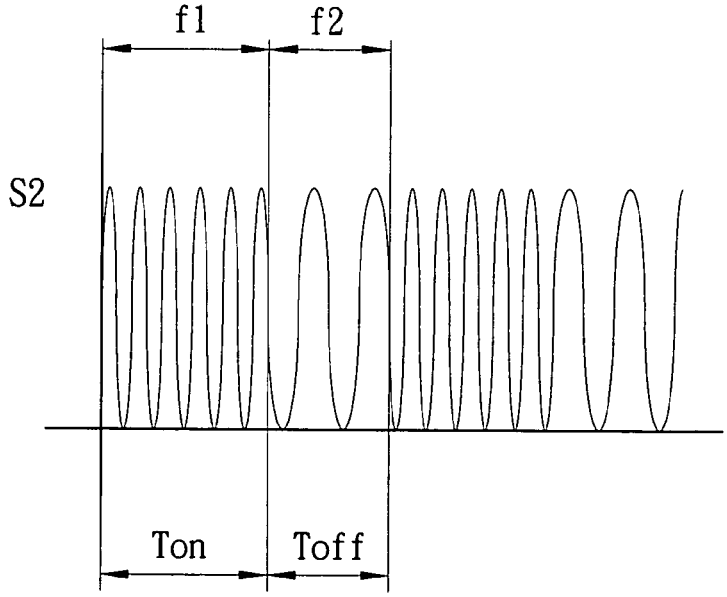
FIG. 5 is a schematic view of a high frequency AC signal S2 corresponding to the pulse width modulation control signal shown in FIG. 4.
Figure 6:
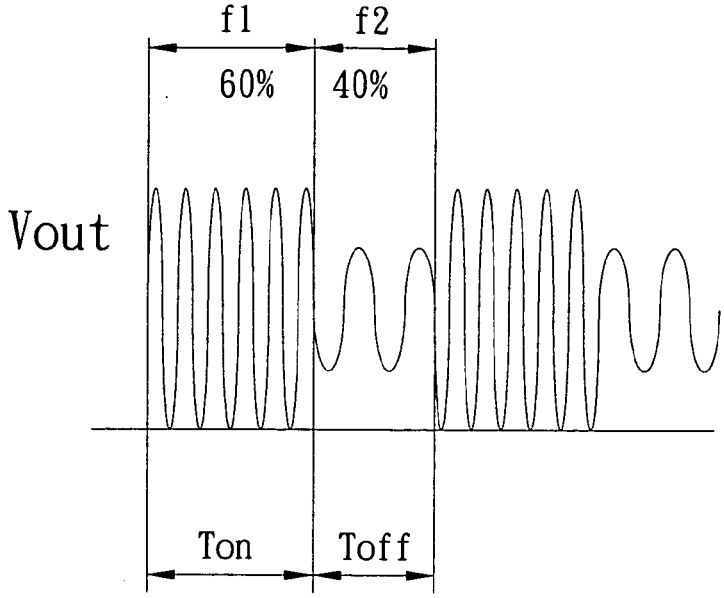
FIG. 6 is a schematic view of the voltage waveform output from the secondary electrode of the piezoelectric transformer corresponding to the high frequency AC signal S2 shown in FIG. 5

Refer to FIGS. 4, 5 and 6 for the operation wave forms during the CCFL 10 is undergoing light modulation according to the invention. These examples are based on DC current voltages between 0V and 3.3 V.

First, assumed the CCFL 10 is at a selected luminosity, the void ratio of the pulse width modulation control signal output from the resonant frequency control unit 40 is 60% as shown in FIG. 4 (i.e. 60% of the time is On $T_{on}$ and 40% of the time is Off $T_{off}$). When the voltage of DC current is 3.3 V at the operation cycle $T_{on}$, the resonant frequency control unit 40 automatically sets the frequency f1 to a higher frequency value (presumed to be 54 kHz) for a higher voltage gain (referring to FIG. 5). If the gain value of the piezoelectric transformer 50 is 100 under the frequency f1 in such a condition, the output voltage output from the secondary electrode 52 will be 100 times of the input voltage value of the primary electrode 51, namely, with the input voltage being 3.3 V at the operation cycle $T_{on}$ the output voltage will be 330 V (CCFL operation voltage is much higher than outer light sources, usually needs 300 to 800 V of AC, depending on the length of the lamp). The resonant frequency control unit 40 automatically changes the frequency f2 of the high frequency AC signal S2 at the operation cycle $T_{off}$ to a frequency value for a lower voltage gain (assumed 58 kHz) (referring to FIG. 5). Hence the corresponding voltage output from the secondary electrode 52 of the piezoelectric transformer 50 will be lower. (Refer to FIG. 6 for the waveform).

Figure 7:
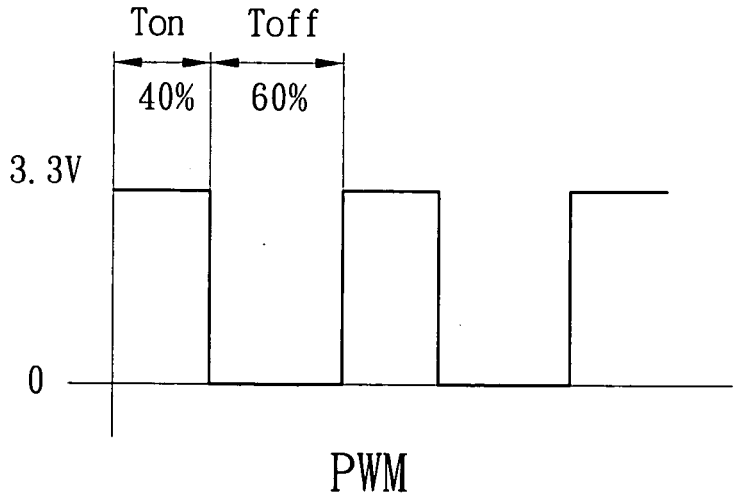
FIG. 7 is a schematic view of the altered waveform of the pulse width modulation control signal shown in FIG. 4 for modulating the CCFL with a lower luminosity.
Figure 8:
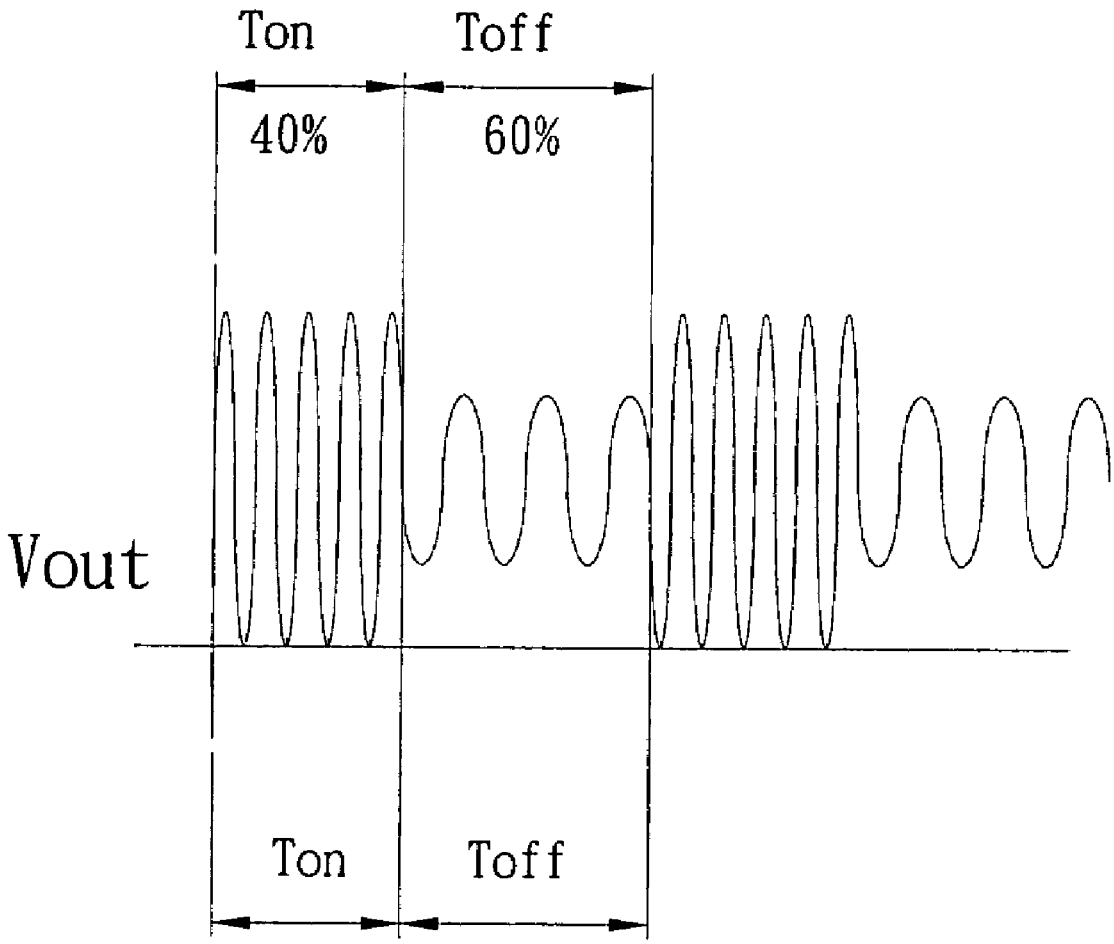
FIG. 8 is a schematic view of the voltage waveform output from the secondary electrode of the piezoelectric transformer corresponding to the pulse width modulation control signal shown in FIG. 7.

Thus by altering the void ratio of the pulse width modulation control signal, the luminosity of the CCFL 10 may be modulated lower. For instance, changing the void ratio of the pulse width modulation control signal to 40% (i.e. $T_{on}$ time period is 40% while $T_{off}$ time period is 60%) or other void ratio can achieve the same effect (refer to FIG. 7 for the waveform). The waveforms of the corresponding voltage output from the secondary electrode 52 of the piezoelectric transformer 50 are shown in FIG. 8.

In addition, according to the method of the invention, the luminosity of the CCFL 10 (or light modulation) may also be modulated by altering the gain of the piezoelectric transformer 50 to change the output voltage $V_{out}$ and output current $I_{out}$ thereof. This may be accomplished by altering the resonant frequencies f1 and f2 of different operation cycles $T_{on}$ and $T_{off}$, and coupling pulse width modulation approach. According to the invention, there still is a lower high frequency AC signal S2 during the operation cycle $T_{off}$ to drive the piezoelectric transformer 50 so that the piezoelectric transformer 50 is operating in a charged condition. Hence it does not cause negative effect to the life span of the piezoelectric transformer 50. Moreover, the invention has the advantages of a simpler structure and a wider light modulation range.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method for modulating light of cold cathode fluorescent lamps (CCFLs) to module a luminosity of a CCFL by altering output voltage and output current of a piezoelectric transformer that actuate the CCEL, comprising:

generating a pulse width modulation control signal that has different operation cycles $T_{on}$ and $T_{off}$; and generating a high frequency AC signal with different frequencies f1 and f2 at the different operation cycles $T_{on}$ and $T_{off}$ of the pulse width modulation control signal to actuate the piezoelectrie transformer to alter the output voltage and the output current of the piezoelectric transformer thereby to module the luminosity of the CCFL;

the piezoelectric transformer generates a first voltage gain at the frequency f1 of the operation cycle $T_{on}$ and generates a secondvoltage gain at the frequency f2 of the operation cycle $T_{off}$, the first voltage gain being greater than the second voltage gain.

2. The method of claim 1, wherein the pulse width modulation control signal is output from a power supply unit controlled by a pulse width modulation technique.

3. The method of claim 1, further including altering a void ratio of the pulse width modulation control signal to modulate the luminosity of the CCFL.

4. The method of claim 1, wherein the high frequency AC signal actuates the piezoelectric transformed to generate different voltage gains at the different frequencies f1 and f2 of the different operation cycles $T_{on}$ and $T_{off}$.

5. An apparatus for modulating light of cold cathode fluorescent lamps (CCFLs), comprising:

a power supply unit to provide DC power required to actuate a CCFL;

a pulse width modulation (PWM) control unit generating a pulse signal through a pulse width modulation technique to control the power supply unit to output a PWM control signal that has different operation cycles $T_{on}$ and $T_{off}$;

a resonant frequency control unit modulating the PWM control signal to become a high frequency AC signal which includes different frequencies f1 and f2 at the different operation cycles $T_{on}$ and $T_{off}$; and a piezoelectric transformer boosting gain of the high frequency AC signal to become a high output voltage and a high output current to actuate the CCFL to generate light;

the high frequency AC signal drives the piezoelectric transformer to generate different voltage gains at the different frequencies f1 and f2 of the different operation cycles $T_{on}$ and $T_{off}$.

6. The apparatus of claim 5, wherein the PWM control signal has an alterable void ration to modulate the luminosity of the CCFL.

7. The apparatus of claim 5, wherein the piezoelectric transformer generates a first voltage gain at the frequency f1 of the operation cycle $T_{on}$ and generates a second voltage gain at the frequency f2 of the operation cycle $T_{off}$, the first voltage gain being greater than the second voltage gain.

* * * * *